United States Patent [19]

Meyer

[11] 3,963,241

[45] June 15, 1976

[54] GAME APPARATUS WITH SOUNDING DEVICE

[75] Inventor: Burton C. Meyer, Downers Grove, Ill.

[73] Assignee: Marvin Glass & Associates, Chicago, Ill.

[22] Filed: Feb. 18, 1975

[21] Appl. No.: 550,205

Related U.S. Application Data

[62] Division of Ser. No. 325,584, Jan. 22, 1973, Pat. No. 3,884,472.

[52] U.S. Cl. ..... 273/121 R; 273/129 R; 46/175 R; 273/121 D; 273/127 D

[51] Int. Cl.[2] ..... A63F 7/00; A63F 7/10

[58] Field of Search..... 273/121 R, 121 A, 121 D, 273/122 R, 122 A, 124 R, 124 A, 125 R, 125 A, 129, 119 R, 127 D; 221/3; 222/39; 46/175

[56] References Cited

UNITED STATES PATENTS 1,606,826 11/1926 Burger ..... 273/119 R 3,176,815 4/1965 Farinola..... 221/3 X

*Primary Examiner*—Richard C. Pinkham
*Assistant Examiner*—William R. Browne
*Attorney, Agent, or Firm*—Coffee & Sweeney

[57] ABSTRACT

A pinball type game in which a ball is propelled by a plunger over an inclined playing surface among pins, targets and the like. The game is designed on a "haunted house" scheme and flippers are provided for keeping a ball in play, the flippers being shaped in the form of bat wings. The flippers actuate a sound device each time a flipper is actuated. The flippers are positioned on each side of the playing surface and are manually operated by the participants. Actuation of a flipper by a participant causes a sound to be emitted by a sounding device. The sounding device includes a bellows portion.

4 Claims, 6 Drawing Figures

HALF SCORE
DOUBLE SCORE

GAME APPARATUS WITH SOUNDING DEVICE

CROSS REFERENCE TO OTHER APPLICATIONS

This is a division of copending application Ser. No. 325,584 filed Jan. 22, 1973, now U.S. Pat. No. 3,884,472.

BACKGROUND AND SUMMARY OF THE INVENTION

This invention relates to a game apparatus and, more particularly, to a pinball type game.

Pinball games or machines have been known for years and comprise an amusement device in which a ball is propelled by a spring biased plunger into play over an inclined playing surface whereby the ball rolls down the surface among pins and targets to score points. Flipper means are provided for actuation by players of the game to keep the ball in play on the playing surface, the flippers usually being positioned so as to propel the ball back up the inclined playing surface. In large commercial type machines, the points are scored electrically as the ball is bounced off of upright scoring columns or through scoring chutes. More simple games of the character described are known and are designed for use by positioning the game on top of a table or the like. In the latter type of games, the scoring or target means normally comprise recesses or curved retainer ribs. This invention is directed to providing a new and improved, novel pinball type game apparatus of the character described.

It is, therefore, a principal object of this invention to provide a new and improved pinball type game.

More particularly, the game apparatus of the present invention has a game board which defines a playing surface over which a playing object, such as a ball or the like, may be propelled. The playing surface is sloped downwardly toward a base scoring area adjacent which a pair of flippers are provided for actuation by players of the game to keep the ball in play on the playing surface. A plunger type ball propelling device is employed along one side of the playing surface for initially putting a ball in play.

In the exemplary embodiment of the invention, the playing board, flippers, target members, and other components are designed on a ghost-type theme, such as a "haunted house" theme. The flippers themselves are shaped in the form of a ribbed irregularly shaped member to simulate bat wings or the like. A bellows actuated sound device in the form of a whistle which gives a "hoot" sound is operatively connected to the flippers to render an audible sound in response to actuation of one of the flippers. Target members shaped in the form of ghosts, or the like, are movably mounted on the playing surface for pivotal movement between a down position, where the members rest on the playing surface, to a generally upright position to expose to view scoring indicia on the underside of the target members.

Another feature of the invention is the provision of a chute device through which a ball can pass as it moves over the playing surface. The chute is mounted for free pivotal movement in response to striking of the chute by a ball to thereby change the angular orientation of the chute. Means is provided for blocking one end of the chute when the chute is in a predetermined angular orientation. A recess is formed in the playing surface beneath the chute, for scoring purposes.

Other objects, features and advantages of the invention will be apparent from the following detailed description taken in connection with the accompanying drawings.

DESCRIPTION OF THE DRAWINGS

FIG. 6 is a broken away perspective view, on an enlarged scale, illustrating the ball release device of the game apparatus shown in FIGS. 1 and 2.

DETAILED DESCRIPTION OF THE INVENTION

Figures 1, 2, 3, 4, 5:
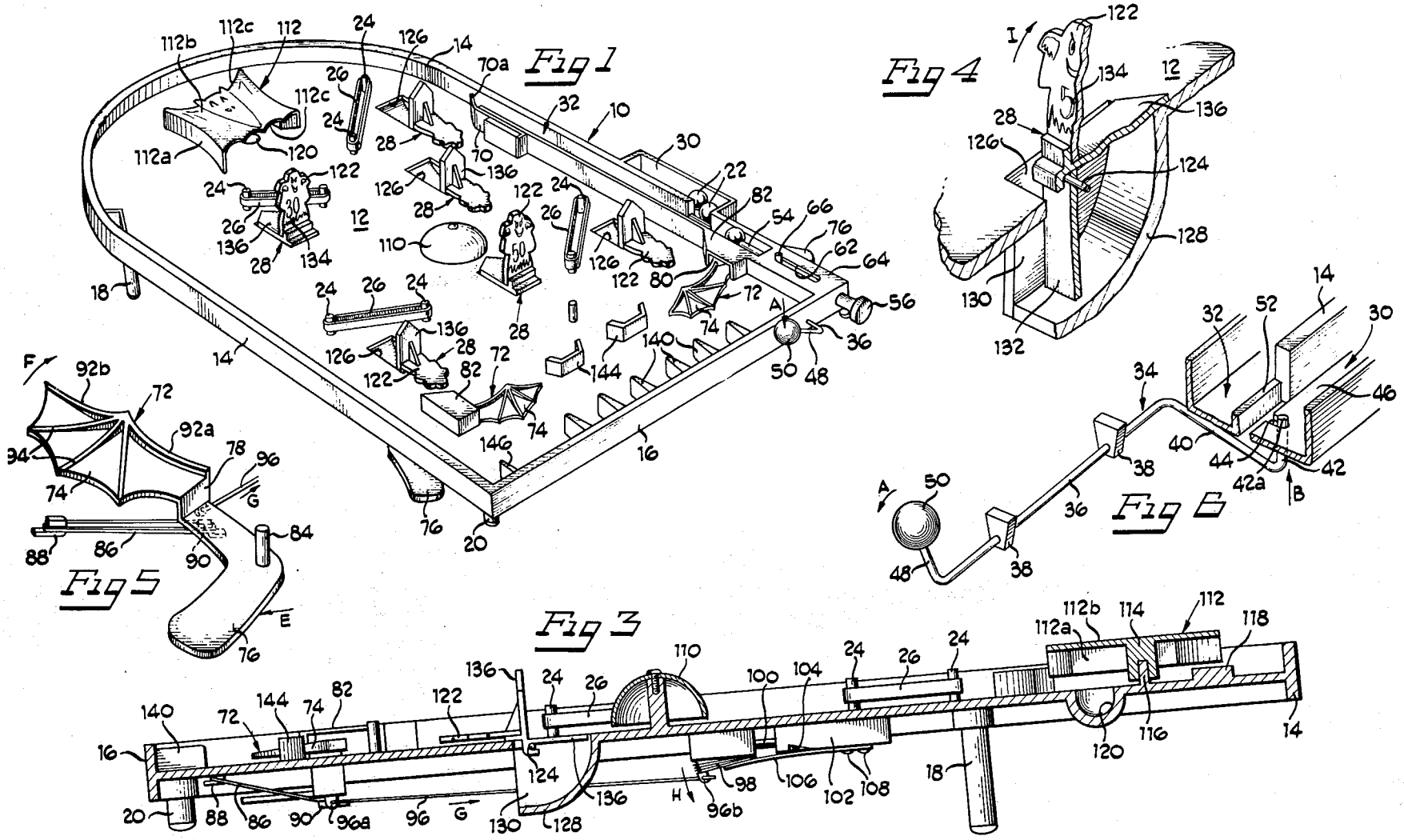
FIG. 1 is a perspective view of a pinball type game apparatus in accordance with the concepts of the present invention.
FIG. 2 is a top plan view, on an enlarged scale, of the game apparatus of FIG. 1.
FIG. 3 is a vertical section taken generally along the line 3—3 of FIG. 2.
FIG. 4 is a broken away perspective view, on an enlarged scale, of one of the movable target members shown in FIGS. 1 and 2.
FIG. 5 is a perspective view of one of the flipper members and associated components.
Figure 2:
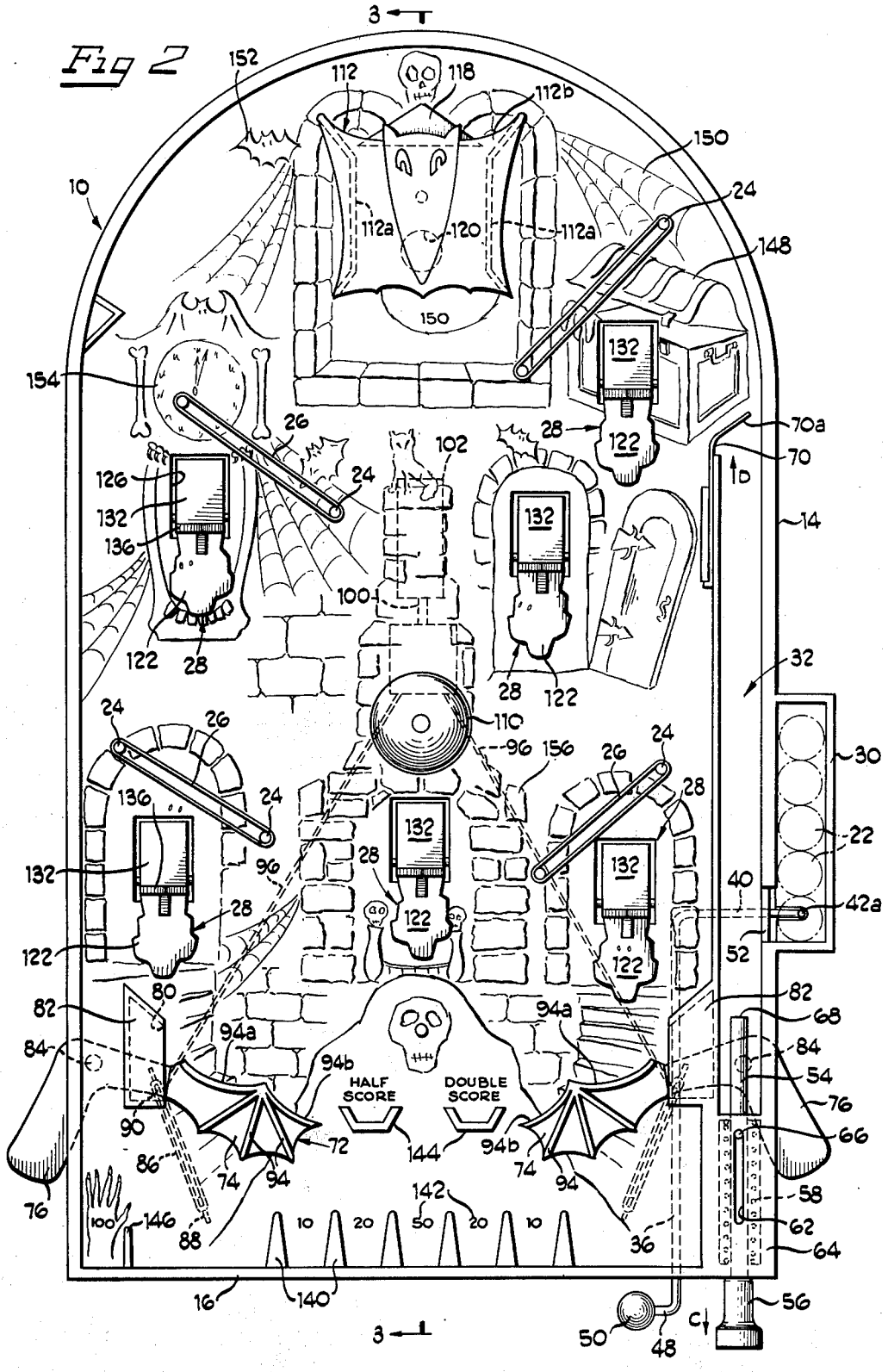

Referring to the drawings in greater detail, the game apparatus of the present invention includes a game board, generally designated 10, which has a playing surface 12 surrounded on three sides by a continuous upright wall 14 and on a fourth side by a base wall 16. As best seen in FIG. 3, the game board 10 is designed for positioning on a table or the like in a raised position by means of a pair of front legs 18 and a pair of base legs 20. Legs 18 are longer than legs 20 so that the playing surface 12 is sloped downwardly toward the base wall 16 so that playing objects in the form of balls 22 roll down the playing surface amongst pins 24, resilient bumpers 26, target members, generally designated 28, and other components on the playing surface.

The balls 22 are initially held in a storage compartment 30 and are fed one at a time into a launching chute 32 by a release mechanism, generally designated 34 (FIG. 6). The ball release mechanism for releasing a ball from the storage compartment 30 into the launching chute 32 is best seen in FIG. 6 and includes a bent rod-like member having a portion 36 journalled in a pair of brace-type brackets 38 fixed to the underside of the game board 10. A rod portion 40 extends at right angles to the portion 36 and underlies the launching chute 32 and part of the storage compartment 30. A generally vertical rod portion 42 is bent upwardly at right angles to the rod portion 40 so that the upper end **42*a* thereof extends through a notch 44 in the floor 46 of the storage compartment 30. A handle portion 48 is exposed on the outside of the base wall 16, as best seen in FIG. 1, and has a knob 50** on the end thereof for manual grasping by a player of the game.

When a ball 22 is positioned at the base end of the storage compartment 30, it is blocked from rolling into the launching chute 32 by a blocking flange 52. In order to move the ball from the storage compartment into the launching chute, the knob 50 is grasped and pushed downwardly in the direction of arrow A (FIGS. 1 and 6) so that the upstanding rod portion 42 is moved upwardly in the direction of arrow B (FIG. 6) whereby the upper end **42*a* thereof engages the underside of the ball and moves it over the blocking flange 52 into the launching chute 32 where the ball is in position to be launched or propelled from the chute 32 onto the playing surface 12**.

The ball propelling device is a spring loaded plunger mechanism which includes a plunger 54 (FIGS. 1 and 2) having a handle portion 56 exposed in front of the base wall 16. A coil spring 58 (FIG. 2) is positioned about the plunger 54 within an interior compartment 60 through which the plunger 54 is reciprocably mounted. A slot 62 is formed in a top wall portion 64 of the game board and a pin 66 fixed to the plunger 54 extends upwardly through the slot 62. The pin 66 thus defines the extreme limits of travel or reciprocating movement of the plunger. In order to propel a ball from the launching chute 32 onto the playing surface 12, the plunger is pulled outwardly in the direction of arrow C (FIG. 2) and released, whereupon the inner end 68 of the plunger 54 strikes a ball 22 and propels the same onto the playing surface 12.

A leaf spring 70 is positioned as best seen in FIG. 2 so that a bent end portion 70a thereof blocks the exit of the launching chute 32. The leaf spring is sufficiently flexible to permit a ball which is propelled by the plunger 54 to be propelled past the leaf spring in the direction of arrow D (FIG. 2), but the spring prevents a ball which is in play on the playing surface 12 from passing back into the launching chute 32.

The other manually actuatable components of the game apparatus of the present invention are a pair of flippers, generally designated 72, one of which is best shown in FIG. 5. The flipper shown in FIG. 5 is the righthand flipper as viewed in FIGS. 1 and 2. Each flipper has a ball engaging portion 74 which overlies the playing surface 12 and a manually manipulatable portion 76 which protrudes outwardly from one side of the game board 10, as best seen in FIGS. 1 and 2. The ball engaging portion 74 and the manually manipulatable portion 76 are offset by an intermediate wall portion 78 which protrudes through a slot 80 (FIG. 2) in the game board. A pair of housing or cover portions 82 are formed on top of the game board to cover the slots 80. The flippers 72 are pivoted to the underside of the game board 10 by pivot pins 84. A rubber band 86 or other resilient biasing means is wrapped around a boss 88 on the underside of the game board and a boss 90 on the underside of the flippers to bias the flippers to a "retracted" position.

In order to actuate a flipper 72, a participant of the game manually exerts a force in the direction of arrow E (FIG. 5) so as to pivot the ball engaging portion 74 in the direction of arrow F for striking the ball and keeping the ball in play.

As mentioned above, the exemplary embodiment of the invention incorporates a "haunted house" scheme and, as seen in the drawings, the ball engaging portions 74 of the flippers are shaped to simulate a bat wing or the like. The actual ball engaging edge of the flippers includes two concave portions 92*a* and 92*b* providing an irregular shape whereby the direction in which a playing object is propelled by the flipper means is at least in part determined by which part of the irregularly shaped engaging flipper portion engages the playing object. Ribs 94 also are provided to simulate the shape of a wing.

Means is provided for rendering an audible sound in response to actuation of one of the flippers 72. More particularly, a rod 96 is secured at one end 96*a* to the underside of each of the flippers 72 and at the other end 96*b* to a bellows 98. A conduit 100 (FIG. 3) establishes air communication between the bellows 98 and a whistle 102 having a sound emitting aperture 104. Preferably, in keeping with the haunted house scheme of the exemplary embodiment of the invention, the whistle 102 is capable of rendering an audible signal such as a "hoot" sound. In order to actuate the whistle 102, as a flipper 72 is actuated to move the ball engaging portion 74 in the direction of arrow F (FIG. 5), the rod 96 is moved in the direction of arrow G (FIGS. 3 and 5). Such movement of the rod expands the bellows in the direction of arrow H (FIG. 3). When the flipper is released, the rubber band 86 pulls the flipper back to its retracted position and causes the bellows 98 to collapse and force air through the whistle 102 to render the audible signal. To facilitate collapsing of the bellows 98, a leaf spring 106 is fixed, as at 108, to the whistle 102 and bears against the underside of the bellows 98.

Turning now to the various components on the game board 12, as mentioned above pins 24 are provided with rubber bands or similar resilient members 26 wrapped around the pins to provide resilient bumpers for a ball 22 as it moves over the playing surface. A bell 110 is provided on the playing surface for emitting an audible signal when a ball 22 strikes the bell. The bell can be worked into the scheme for scoring the game.

Referring to the top of the game board 12, a chute member, generally designated 112, is positioned on the playing surface. The chute has side walls 112*a* and a top wall 112*b* and open ends 112*c*. As seen in FIGS. 1 and 2, the chute is shaped in the form of a ghost, or the like. The chute is pivotally mounted to the playing surface by a boss 114 (FIG. 3) on the underside thereof which is positioned on top of a pivot pin 116 which protrudes upwardly from the playing surface 12. As best seen in FIGS. 2 and 3, a blocking rib 118 is formed on the playing surface in order to block one of the open ends of the chute, should the chute be in the angular orientation shown in FIGS. 1 and 2. The chute should be sufficiently free to rotate on the pivot pin 116 so that a ball 22 striking the chute will cause the chute to rotate to different angular orientations. A recess 120 is formed in the playing surface beneath the chute 112 and is provided for scoring purposes. Because of the difficultness in playing a ball into the recess 120, a high score may be provided (e.g., 150 points as shown in FIG. 2). Of course, when the chute is positioned in the angular orientation shown in FIGS. 1 and 2, the only avenue for a ball toward the recess 120 is from the open end of the chute which faces the base of the game board.

The target members 28 are best described with reference to FIG. 4 where one of the target members is shown in its upright position. More particularly, each target member 28 has a target portion 122 which, at the start of a game of play, is positioned so that it rests on top of the playing surface as best seen by the target members shown in FIG. 2 as well as three of the five target members shown in FIG. 1. Each target member 28 is pivoted by means of a pin 124 (FIG. 4) adjacent to or within an aperture 126 formed in the playing surface 12. A receptacle is formed beneath each aperture 126 by means of an arcuate wall 128 and a pair of side walls 130. When the target portion 122 of a target member 28 is positioned so as to rest on top of the playing surface 12, an actuating portion 132 of the target member 28 substantially covers the aperture 126. Should a ball 122 moving across the playing surface 12 roll onto the top of the actuating portion 132, the weight of the ball 22 will cause the target member 28 to pivot in the direction of arrow I (FIG. 4) to pivot the target portion 22 thereof to an upright position as shown in FIGS. 4 and expose scoring indicia 134 on the underside thereof. Of course, the actuating portion 132 of the target member 28 should be slightly smaller than the aperture 126, and a ball 22 should be of sufficient weight as to effect the aforesaid pivoting of the target member. The target member 28 thus comprises a lever and the lever also has a bell crank portion 136 which is larger in size than the aperture 126 so that it overlies at least portions of the playing surface 12 about the aperture 126 as best seen in FIG. 4 to define the upright position of the target portion 122 while at the same time blocking the aperture 126.

A ball 22 which causes pivoting of a target member 28 will fall into the receptacle formed by the walls 128 and 130. After a play of the game, the target member simply is pivoted opposite the direction of arrow I (FIG. 4) and the portion 132 thereof will raise the ball back into position for grasping by a player of the game.

Other scoring features are provided at the base of the playing surface 12 and are shown best in FIGS. 1 and 2. More particularly, a plurality of ribs 140 are spaced along the inside of the base wall 16. Scoring indicia 142 is provided in the spaces between the ribs 140 to provide scoring means should a ball 22 come to rest between two of the ribs. A pair of cup-shaped ribs 144 are also positioned on the playing surface in front of the ribs 140 for other scoring purposes such as to cut a player's score in half or to double a player's score, as indicated. Still another rib 146 is provided at the left-hand side of the base wall 16 to provide a slot at the corner of the playing surface for scoring purposes.

As seen in FIG. 2, the actual playing surface itself may be provided with indicia representing figures, structures, or the like which coincide with the scheme of the game afforded by the bat wing flippers 72, ghose-like chute 112, ghost-like scoring members 28, and the "hooting" whistle 102. Such indicia may take the form of a simulated treasure chest 148, spider webs 150, bats 152, old clock 154, fireplace 156, and other similar indicia.

The foregoing detailed description has been given for clearness of understanding only and no unnecessary limitations should be understood therefrom as some modifications will be obvious to those skilled in the art.

I claim:

1. In a pinball type game, or the like, which includes means defining a playing surface over which a playing object may be propelled, a playing object to be propelled upon said playing surface, a playing object propelling device located in proximity to said playing surface so as to be capable of propelling a playing object upon said playing surface, said propelling device including flipper means selectively operable by participants of the game to propel the playing object over the playing surface when the playing object moves into contact with said flipper means, and means selectively actuatable by participants of the game and operatively connected to said flipper means to operate the same, the improvement in said propelling device comprising sound means distinct from the operative connection between said means selectively actuatable by participants of the game and said flipper means, and means operatively connecting said sound means to said means selectively actuatable by participants of the game for rendering an audible sound in response to actuation of said means selectively actuatable by participants of the game.

2. The game of claim 1 wherein said sound means has a bellows portion and an air actuatable sound emitting portion in communication with the bellows portion, the bellows portion being operatively connected to said flipper means so as to expand the bellows portion on actuation of the means selectively actuatable by participants of the game.

3. The game of claim 2 including means for biasing the bellows portion to a contracted condition to render the audible sound when the means selectively actuatable by participants of the game is released.

4. The game of claim 3 wherein said game is played on a "haunted house" type theme and said sound emitting portion comprises a whistle for emitting a "hooting" sound.

* * * * *